US007559441B2

(12) United States Patent
Yu

(10) Patent No.: US 7,559,441 B2
(45) **Date of Patent: *Jul. 14, 2009**

(54) LEAKPROOF PERFUME SPRAY HEAD STRUCTURE

(75) Inventor: Yuan-Wen Yu, Taoyuan Hsien (TW)

(73) Assignee: Ing Wen Precision Ent. Co., Ltd., Taoyuan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/543,976

(22) Filed: Oct. 6, 2006

(65) Prior Publication Data

US 2008/0087692 A1 Apr. 17, 2008

(51) Int. Cl.
*B67D 5/06* (2006.01)

(52) U.S. Cl. ..... 222/183; 222/520; 222/633; 222/548; 222/549; 222/531; 222/553; 222/535; 239/302; 239/304; 239/348; 239/349; 239/333

(58) Field of Classification Search ..... 239/302, 239/333, 304, 327, 348, 349; 222/183, 633, 222/553, 549, 548, 562, 535, 531, 537, 521, 222/520, 519

See application file for complete search history.

(56) References Cited

U.S. PATENT DOCUMENTS 1,968,316 A * 7/1934 Schmitt ..... 222/153.08
2,837,374 A * 6/1958 Lipman ..... 239/354
2,886,199 A * 5/1959 Lipman ..... 215/317
3,176,883 A * 4/1965 Davis, Jr. ..... 222/633
4,595,002 A * 6/1986 Michaels et al. ..... 128/200.21
4,595,127 A * 6/1986 Stoody ..... 222/135
4,769,137 A * 9/1988 Powell, Jr. ..... 210/139
5,027,986 A * 7/1991 Heinzel et al. ..... 222/402.24
6,616,067 B1 * 9/2003 Hunter ..... 239/338
6,814,267 B2 * 11/2004 Ingram ..... 222/520
6,923,349 B2 * 8/2005 Lou ..... 222/521
7,080,760 B2 * 7/2006 Yu ..... 222/633
7,080,761 B1 * 7/2006 Yu ..... 222/633
2003/0094430 A1 * 5/2003 Stull et al. ..... 215/321
2003/0127467 A1 * 7/2003 Adams et al. ..... 222/153.14

* cited by examiner

*Primary Examiner*—Len Tran
*Assistant Examiner*—Trevor E. McGraw

(57) ABSTRACT

A leakproof perfume spray head structure comprises a spray head, a locking shell, an inner sleeve, a rotation shaft, a water guide pipe, and an outer cover, wherein the spray head has gaps for better communicating the gas with the perfume liquid so as to spray out more uniform perfume mists. When the spray head is opened, but not in use, the spray head can be rotated by a certain angle so as to close the inner spray tunnel of the spray head completely to prevent the perfume liquid from leakage.

4 Claims, 8 Drawing Sheets

LEAKPROOF PERFUME SPRAY HEAD STRUCTURE

FIELD OF THE INVENTION

The present invention relates to an easy-to-assembly leakproof perfume spray head structure for forming the uniform perfume spray, and more particularly to an improved perfume spray head structure that has a locking structure capable of effectively preventing the perfume bottle from leakage during its transportation process and when it encounters heat.

BACKGROUND OF THE INVENTION

In a general perfume bottle, the perfume liquid is sprayed out by the use of a compressible ball. When the gas is squeezed out of a spray nozzle by compressing the compressible ball, the perfume liquid is also sprayed out from the perfume bottle to form the perfume mists. However, a spray head of this kind of spraying-type perfume bottle has small components, which are not easily attachable. In addition, when these components are positioned in the main body of the spray head, the phenomenon of displacement occurs easily. Accordingly, it is difficult to perform the assembly process, and the production yield is very poor. In addition, the spray tunnel is narrow and jammed easily, which causes the formation of non-uniform perfume mists easily.

SUMMARY OF THE INVENTION

A main object of the present invention is to provide a leakproof perfume spray head structure. When the spray head is assembled or not in use, the spray head can be rotated by a small angle so as to close the inner spray tunnel of the spray head completely to prevent the perfume liquid from leakage. If it is in use, the spray head is reversely rotated by a small angle to open the inner spray tunnel of the spray head.

Another object of the present invention is to provide gaps for better communicating the gas with the perfume liquid, wherein these gaps do not hinder the gas from mixing with the perfume liquid so that the obtained perfume mists can be more uniform. In addition, the perfume liquid can be guided to pass through the spray nozzle exactly so as to obtain uniform perfume mists.

DETAILED DESCRIPTION OF THE PREFERRED EMBODIMENT

Figure 1:
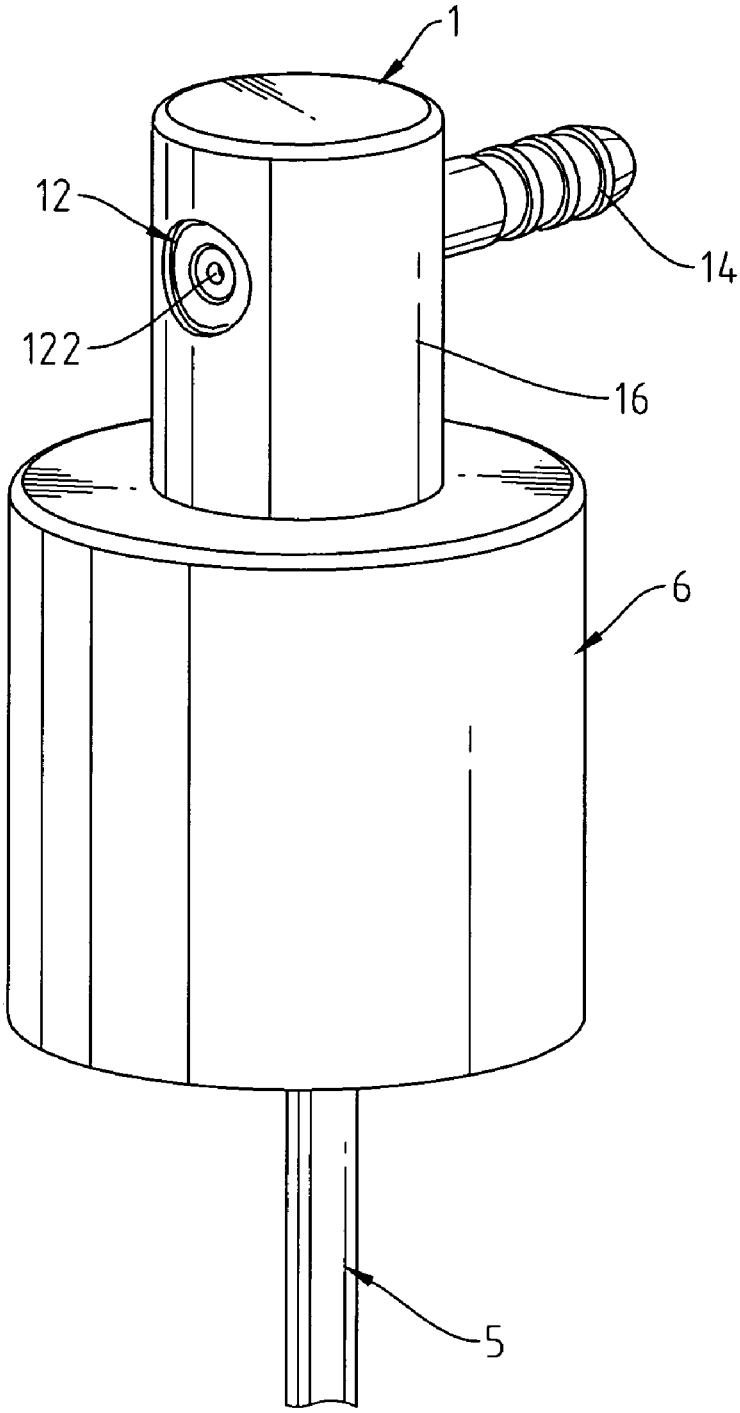
FIG. 1 is an assembled, elevational view showing the spray head structure of the present invention.

As shown in FIG. 1 through FIG. 3 and FIG. 6, the leakproof perfume spray head structure of the present invention generally comprises a spray head 1, a locking shell 2, an inner sleeve 3, a rotation shaft 4, a water guide pipe 5, and an outer cover 6, wherein the inner sleeve 3 and the rotation shaft 4 are assembled to the inside of the locking shell 2, and the rear end of the inner sleeve 3 is coupled with the water guide pipe 5. In addition, the locking shell 2 is covered with the outer cover 6.

Figure 2:
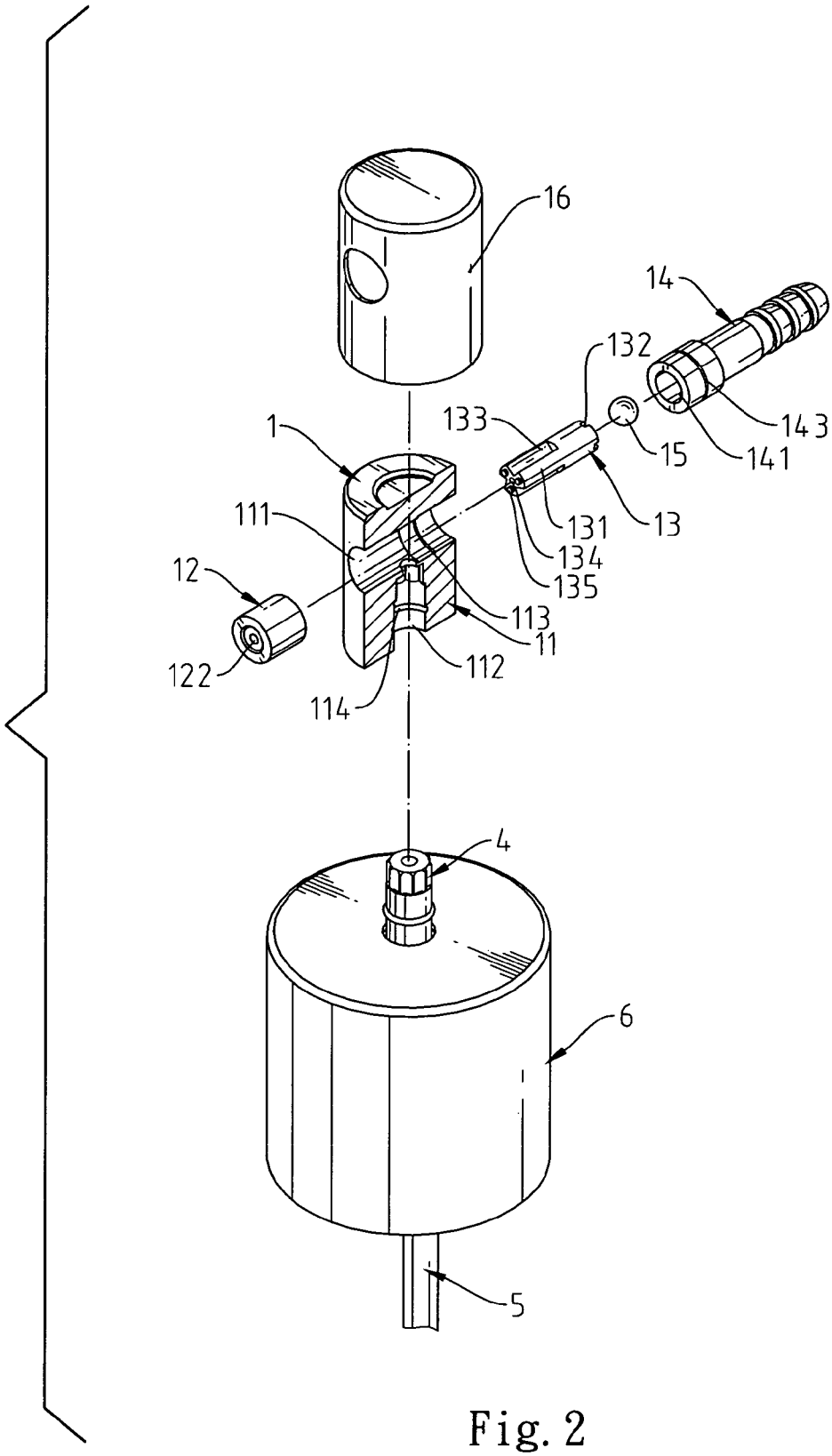
FIG. 2 is an elevational, partial-decomposed view showing the spray head structure of the present invention.

Referring to FIGS. 1 and 2, the structure of the spray head 1 is shown. A spray nozzle 12, a gas guide device 13, a gas supply tube 14, and a rolling ball 15 are pre-assembled to the inside of a main body 11 of the spray head 1 and then coupled with an outer cover 16. By the use of the pre-assembled structure, the assembly process can be performed easily and the occurrence of displacement can be avoided.

The aforementioned spray head 1 includes a horizontal receiving hole 111 and an inner-toothed hole 112, which are communicated with each other in a T shape. The horizontal receiving hole 111 is designed for holding and positioning the spray nozzle 12 and the gas supply tube 14 that are assembled together. The gas guide device 13 has a shaft body 131 having a gas hole 134 penetrating through the center thereof. In addition, several notches 132 are formed on one end of the shaft body 131. Several liquid guide trenches 133 are formed axially on the other end of the shaft body 131, and several bumps 135 are formed on the edge of the shaft body 131 adjacent to the liquid guide trenches 133.

An external compressible ball can be attached to one end of the gas supply tube 14 so as to generate gas for spraying out the perfume liquid. A coupling hole 141 is formed on the other end of the gas supply tube 14. The rolling ball 15 is mounted in the coupling hole 141, and a protrudent ring 143 is formed around the outside of the coupling hole 141.

When assembling the spray head 1, the coupling part of the shaft body 131 of the gas guide device 13 is inserted into the coupling hole 141 of the gas supply tube 14, and the other end of the shaft body 131 is partially coupled with the inside of an action chamber 121 of the spray nozzle 12. The liquid guide trenches 133, which are located on the inside of the action chamber 121, can guide the perfume liquid since their partial sections are exposed to the outside and not coupled with the spray nozzle 12 and the gas supply tube 14. After the spray nozzle 12, the gas guide device 13, and the gas supply tube 14 are assembled together, they can be positioned in the horizontal receiving hole 111 of the main body 11 directly in such as a manner that the protrudent ring 143 of the gas supply tube 14 can be positioned into and engaged with a recessed circular trench 113, which is formed on the inner surface of the horizontal receiving hole 111.

Figure 8:
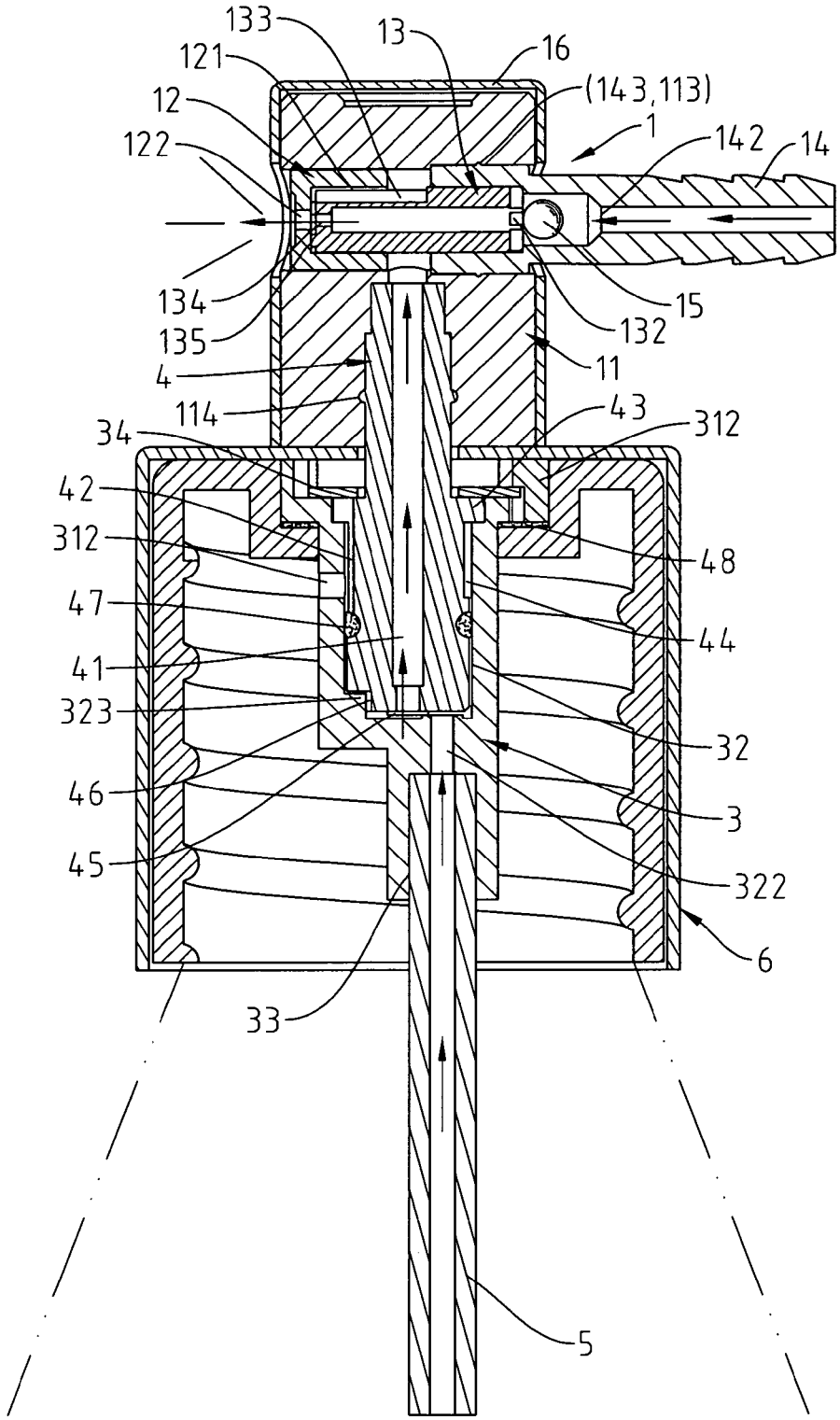
FIG. 8 is a cross-sectional view showing that the guide hole of the inner sleeve of the spray head structure of the present invention is opened.

Referring further to FIG. 2 and FIG. 8, after the assembled spray nozzle 12, gas guide device 13, and gas supply tube 14 are positioned in the horizontal receiving hole 111 of the main body 11, the spray nozzle 12 is located in the front end of the horizontal receiving hole 111. In addition, the shaft body 131 of the gas guide device 13, which is located between the spray nozzle 12 and the gas supply tube 14, is communicated with the axial through hole 112. The gas guide device 13, which locates between the spray nozzle 12 and the gas supply tube 14, has several bumps 135 and notches 132 on both sides, respectively. The notches 132 of the shaft body 131 are designed to prevent the gas, which is supplied via the gas supply tube 14, from being blocked so that the gas can be guided into the gas hole 134 of the gas guide device 13 via the notches 132. The bumps 135 of the shaft body 131 are designed to form gaps between the action chamber 121 of the spray nozzle 12 and the liquid guide trenches 133 to allow the perfume liquid to pass therethrough. As a result, the gas, which is supplied via the gas supply tube 14, is allowed to enter the gas guide device 13 by the use of the gaps formed between the notches 132 of the gas guide device 13 and the coupling hole 141 of the gas supply tube 14. At this moment, the perfume liquid is shifted into the main body 11 by pressure. After mixing the gas with the perfume liquid, the perfume liquid is sprayed out via the gaps between the bumps 135 of the shaft body 131 of the gas guide device 13 and the action chamber 121 of the spray nozzle 12 so as to form uniform perfume mists.

Figure 3:
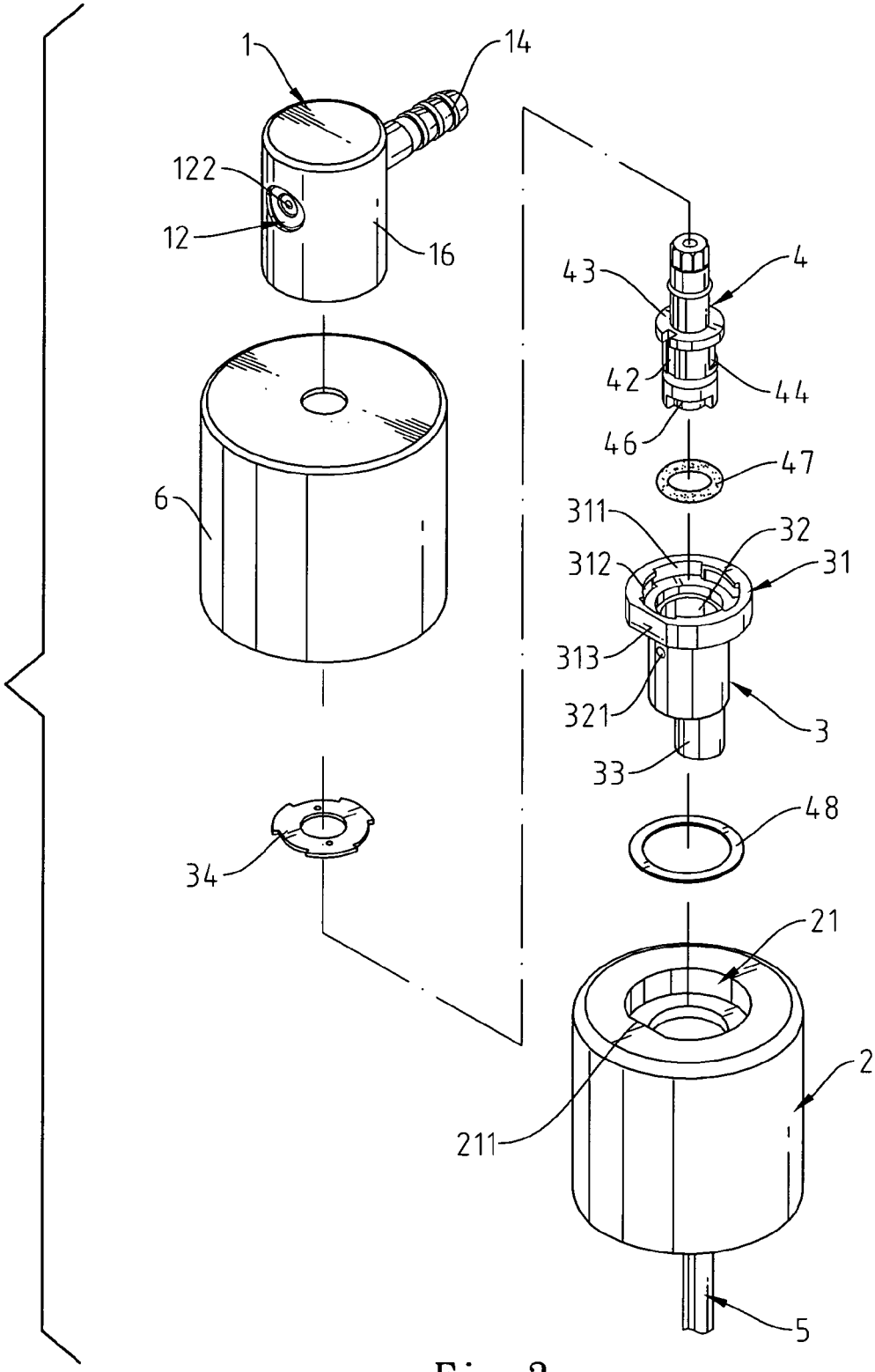
FIG. 3 is an elevational, decomposed view showing the leakproof structure of the present invention.
Figure 4:
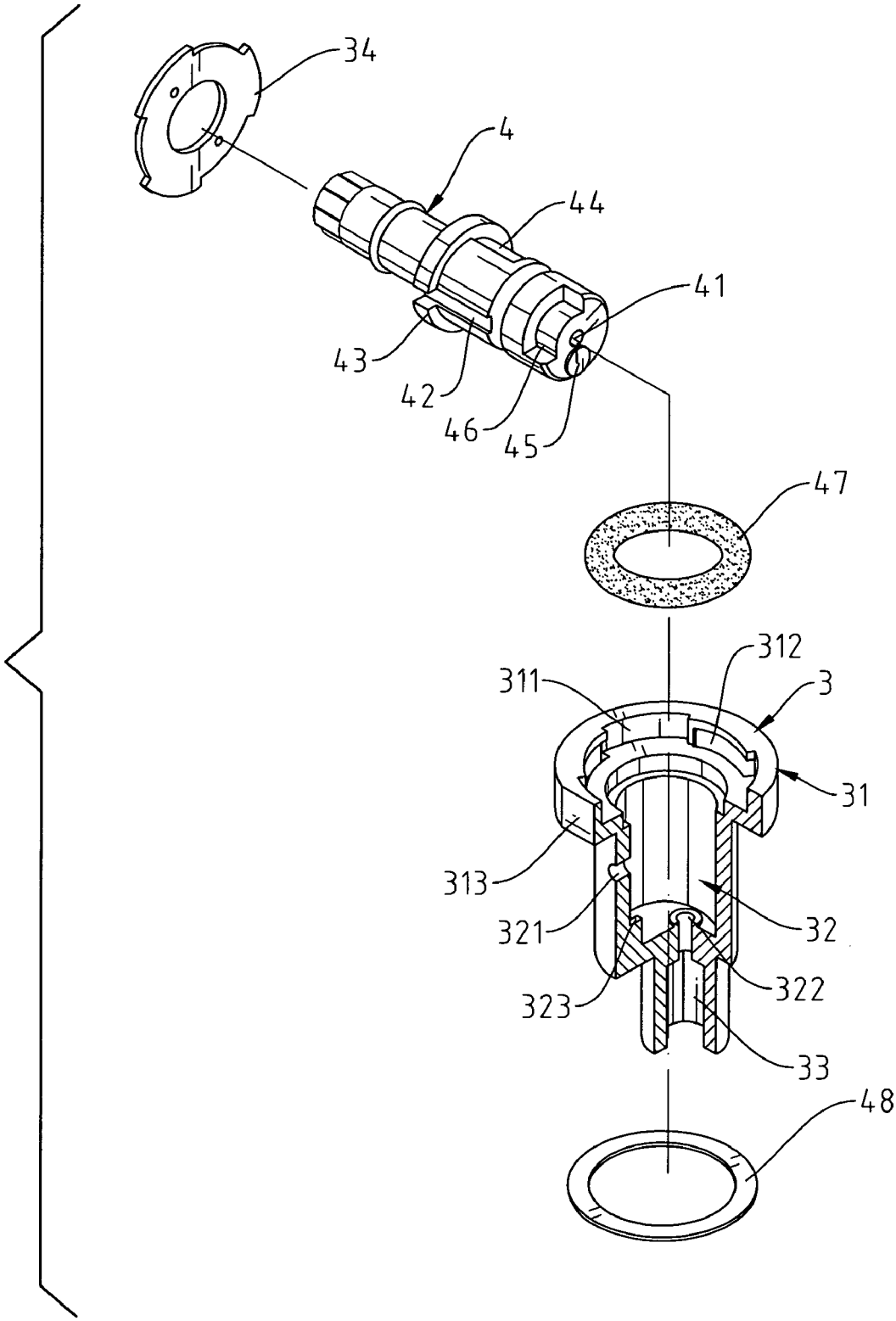
FIG. 4 is an elevational, partial-decomposed view showing the leakproof structure of the present invention.

Referring to FIGS. 3, 4, and 8, the leakproof structure that couples with the lower portion of the spray head 1 comprises the locking shell 2, the inner sleeve 3, the rotation shaft 4, the water guide pipe 5, and the outer cover 6, wherein the locking shell 2, the inner sleeve 3, and the rotation shaft 4 are assembled to the inside of the outer cover 6, and the rotation shaft 4 are coupled with the spray head 1.

A screwing part (not shown) formed inside the locking shell 2, which is mounted inside the outer cover 6, is coupled with a perfume bottle (not shown). A circular trench 21 that has a flat connection part 211 on its inner surface is formed on the top of the locking shell 2. The circular trench 21 is designed for coupling with the inner sleeve 3 steadily.

The inner sleeve 3 has a coupling body 31, wherein the flat connection part 211 of the locking shell 2 is attached to a flat cutting edge 313 of the coupling body 31 so that a sleeving section 33 that forms on the lower end of the inner sleeve 3 is inserted into the locking shell 2. The inner sleeve 3 has a coupling trench 311 inside the coupling body 31, wherein the center of the coupling trench 311 is communicated with a holding chamber 32. The coupling section 33, which is integrally formed on the lower portion of the holding chamber 32, can be coupled with the water guide pipe 5.

The rotation shaft 4 has a through hole 41 formed therein and an O-ring 47 sleeved onto its lower outer portion. In addition, a gasket 48 is sleeved onto the rotation shaft 4 so as to form airtight and leakproof connection between a protrudent ring 43 of the rotation shaft 4 and the locking shell 2. In addition, the protrudent ring 43 is mounted on the outer center of the rotation shaft 4, and a liquid guide trench 42 is formed axially between the protrudent ring 43 and the O-ring 47. In order to reduce the sound caused by the rotation shaft 4 that rubs against the holding chamber 32 of the inner sleeve 3 during rotation, several recessed portions 44 are formed on the rotation shaft 4.

The holding chamber 32 of the inner sleeve 3, has a gas hole penetrating therethrough. A retaining part 323 is formed on the bottom of the holding chamber 32. A guide hole 322 is bias formed on the bottom surface of the holding chamber 32, wherein the guide hole 322 is communicated with the coupling section 33. When the rotation shaft 4 is mounted in the inner sleeve 3, the protrudent ring 43 of the rotation shaft 4 is held in the coupling trench 311 of the inner sleeve 3, and the rotation shaft 4 is partially held in the holding chamber 32. In order to prevent the rotation shaft 4 from separation from the inner sleeve 3, a positioning ring 34 is sleeved onto the rotation shaft 4, wherein the positioning ring 34 is fixed by a positioning ring 312 to prevent the rotation shaft 4 from separating from the inner sleeve 3 inadvertently.

Moreover, after the rotation shaft 4 and the inner sleeve 3 are assembled to the locking shell 2, the outside of the locking shell 2 is covered by the outer cover 6 to fix and position these components therein.

Figure 5:
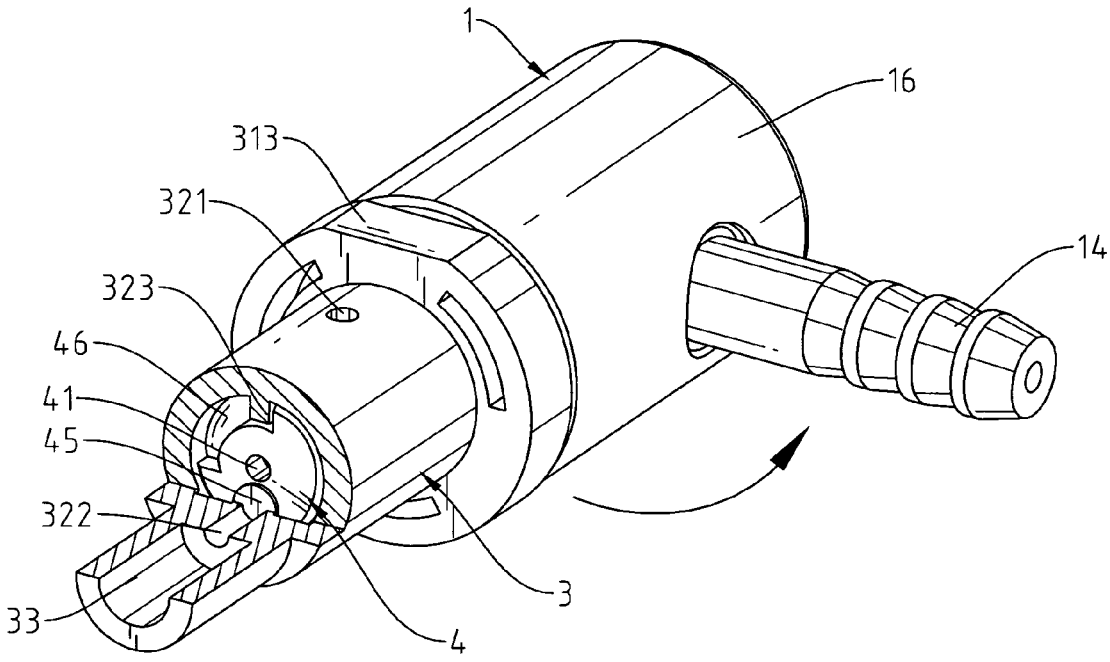
FIG. 5 is an elevational view showing that the spray head structure of the present invention is closed.
Figure 6:
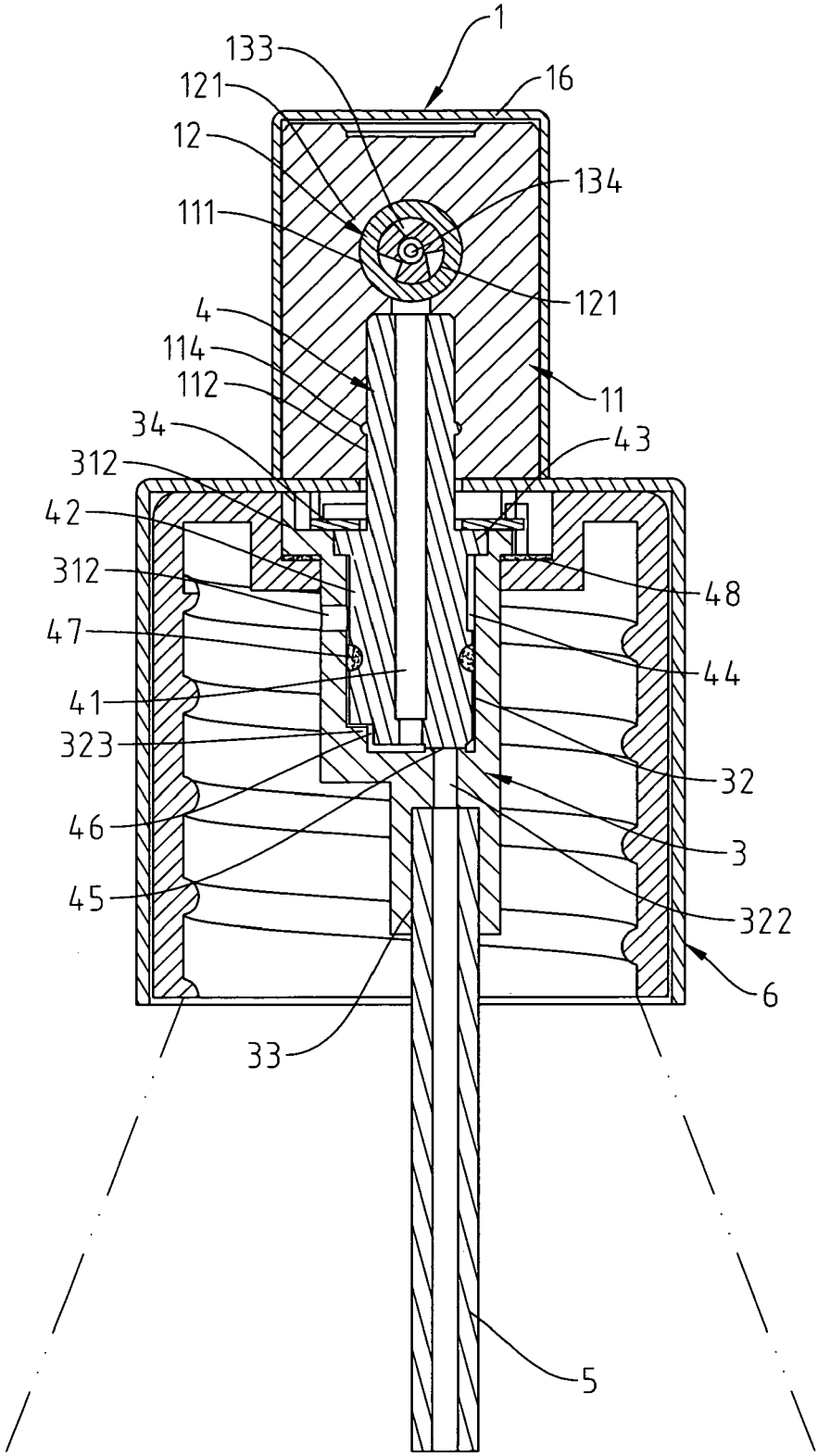
FIG. 6 is a cross-sectional view showing that the spray head structure of the present invention is closed.

The operation of the leakproof perfume spray head structure of the present invention is shown in FIG. 5 and FIG. 6. According to the aforementioned structure, the top of the rotation shaft 4 is tightly coupled with the inside of the spray head 1. Therefore, the rotation shaft 4 is rotated by the rotation of the spray head 1. In addition, a right-angled notch 46 is formed on the bottom of the rotation shaft 4 so that the rotation angle of the rotation shaft 4 can be confined by the retaining part 323, which is mounted in the holding chamber 32 of the inner sleeve 3. Besides, a bump 45, which is located on the bottom of the rotation shaft 4, can be rotated by the rotation of the rotation shaft 4.

The method for closing the liquid spray tunnel formed between the rotation shaft 4 and the inner sleeve 3 is shown in FIGS. 5 and 6. When the spray head 1 is rotated by about 90 degrees, the rotation shaft 4 that connects thereto can be also rotated so as to synchronously insert the bump 45 of the rotation shaft 4 into the guide hole 322 of the inner sleeve 3 to close the guide hole 322 for preventing the perfume liquid inside the from overflow and leakage.

Figure 7:
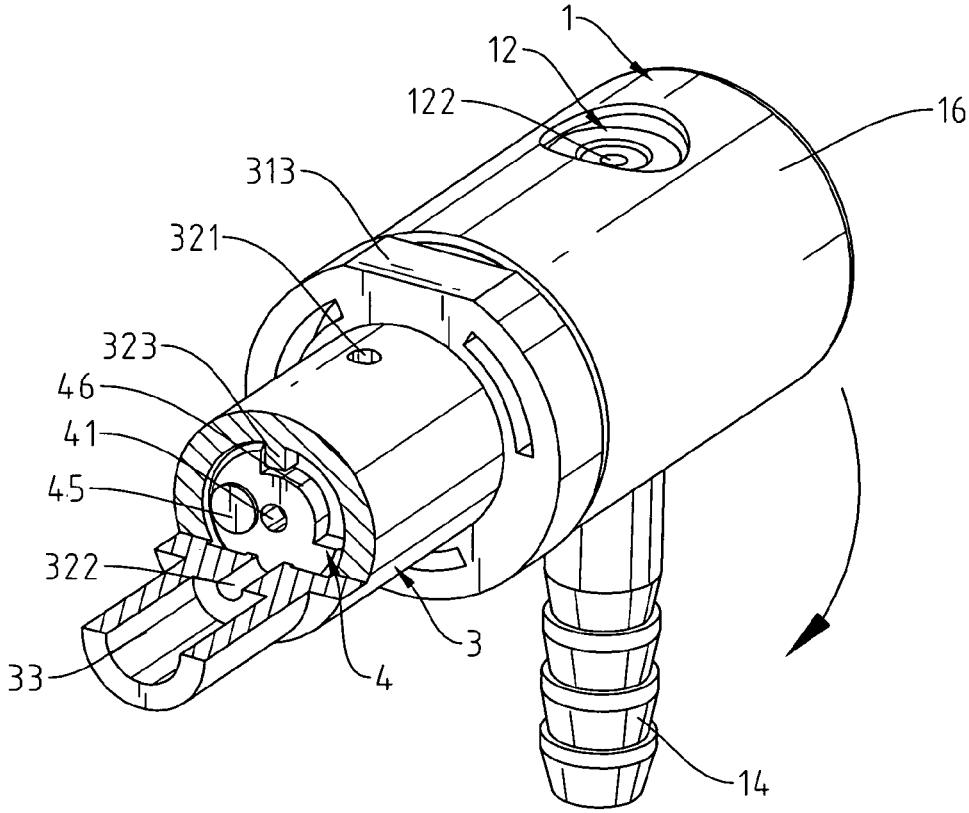
FIG. 7 is an elevational view showing that the guide hole of the inner sleeve of the spray head structure of the present invention is opened.

Furthermore, the structure of the perfume spray head for spraying the perfume liquid in accordance with the present invention is shown in FIG. 7 and FIG. 8. In accordance with the aforementioned structure, the rotation shaft 4 can be rotated by the spray head 1 to prevent the perfume liquid from overflow and leakage. If it is desired to open the spray head 1, the spray head 1 is reversely rotated by about 90 degree so as to separate the bump 45 of the rotation shaft 4 from the guide hole 322 of the inner sleeve 3. At this moment, the bump 45 is held on the holding chamber 32 so as to form a spray tunnel to allow the perfume liquid to pass therethrough. As a result, the perfume liquid can be guided into the through hole 41 of the rotation shaft 4 for being sprayed out uniformly from the spray head 1.

In addition, a gas hole 321 is formed on the inner sleeve 3 to prevent the pressure inside the perfume bottle from unbalance when the perfume liquid is sprayed out, wherein the gas hole 321 provides the gas convection, balances the atmospheric pressure, and avoids the perfume leakage.

The leakproof perfume spray head structure of the present invention accomplishes the purposes of closing and opening the perfume bottle by rotation. As a result, if the perfume bottle is not in use or if it is in transportation, the spray head 1 can be rotated to enable the rotation shaft 4 to readily seal the inner spray tunnel. Consequentially, the perfume bottle is protected against the problems of leakage and overflow when it is in either the transportation process or the high-temperature/high-pressure conditions. Furthermore, if it is desired to utilize the perfume bottle, the spray head is merely rotated by an angle to enable the rotation shaft to open the spray tunnel for spraying out the perfume liquid.

What the invention claimed is:

1. A leakproof perfume spray head structure comprising:

a spray head, a locking shell, an inner sleeve, a rotation shaft, a water guide pipe, and an outer cover, wherein said rotation shaft is mounted in said inner sleeve so that the perfume liquid can be sprayed out via said rotation shaft and said spray head that connects thereto, wherein the improvement comprises:

a circular trench formed above said locking shell;

said inner sleeve having a coupling body on a holding chamber thereof, a coupling section being integrally formed on a lower portion of said inner sleeve for insertion into said locking shell, said coupling section being coupled with said water guide pipe, a retaining part being formed on the bottom of said holding chamber of said inner sleeve, a guide hole being bias formed on the bottom surface of said holding chamber for communication with said coupling section; and said rotation shaft having a through hole formed therein, a liquid guide trench being formed axially on the outer center portion of said rotation shaft, and a notch and a bump being formed on the bottom of said rotation shaft, wherein said through hole of said rotation shaft is communicated with said holding chamber of said inner sleeve by coupling said rotation shaft with said inner sleeve, wherein the rotation of said rotation shaft is confined by said retaining part mounted inside said holding chamber of said inner sleeve by the use of said notch formed on the bottom of said rotation shaft, wherein the rotation of said rotation shaft can control the relative positions between said bump mounted on the bottom of said rotation shaft and said guide hole of said inner sleeve so as to close or open said guide hole for controlling the spraying status of said perfume liquid.

2. The leakproof perfume spray head structure of claim 1, wherein said coupling body of said inner sleeve is held in said circular trench of said locking shell, and said circular trench has a flat connection part for coupling with a flat cutting edge of said coupling body.

3. The leakproof perfume spray head structure of claim 1, wherein a plurality of recessed portions are formed on said rotation shaft to reduce friction.

4. The leakproof perfume spray head structure of claim 1, wherein a gas hole is formed on said inner sleeve to communicate with said holding chamber.

* * * * *